US005184358A

United States Patent [19]

Gruidel et al.

[11] Patent Number: 5,184,358

[45] Date of Patent: Feb. 9, 1993

[54] BATHING TUB CONSTRUCTION WITH REMOVABLE SIDE WALL

[75] Inventors: James A. Gruidel; Reinhold A. Haase, both of Hastings; Thomas G. Johnson, Blue Hill, all of Nebr.

[73] Assignee: Dutton-Lainson Company, Hastings, Nebr.

[21] Appl. No.: 765,362

[22] Filed: Sep. 24, 1991

[51] Int. Cl.[5] ..... A47K 3/14

[52] U.S. Cl. ..... 4/555; 49/466; 277/227

[58] Field of Search ..... 4/555, 556, 584; 49/466, 463, 280; 277/235 R, 227, 138; 292/201, 341.16; 220/346, 345

[56] References Cited

U.S. PATENT DOCUMENTS

| | | | |
|---|---|---|---|
| 2,456,275 | 12/1948 | Harris | 4/556 |
| 3,403,934 | 10/1968 | Butts | 292/341.16 |
| 3,423,769 | 1/1969 | Cowley | 4/556 |
| 3,861,081 | 1/1975 | Maskell | 49/463 X |
| 3,863,275 | 2/1975 | Brendgord et al. | 4/556 |
| 4,478,437 | 10/1984 | Skinner | 277/138 X |
| 4,546,506 | 10/1985 | Houle et al. | 4/555 |
| 4,672,693 | 6/1987 | Schenström | 4/555 |
| 4,680,817 | 7/1987 | Sloan et al. | 4/556 X |
| 4,682,443 | 7/1987 | Demo | 49/466 |
| 4,802,247 | 2/1989 | Leichle et al. | 4/556 |
| 4,892,340 | 1/1990 | Matumoto | 292/341.16 X |

FOREIGN PATENT DOCUMENTS

| | | | |
|---|---|---|---|
| 1226206 | 3/1971 | United Kingdom | 4/555 |
| 1582900 | 1/1981 | United Kingdom | 4/555 |

*Primary Examiner*—William A. Chuchlinski, Jr.
*Assistant Examiner*—John L. Beres
*Attorney, Agent, or Firm*—Allegretti & Witcoff, Ltd.

[57] ABSTRACT

The bathing tub assembly includes a removable side wall panel which is slidably engageable with a slot along the edge of an opening through the side wall of the tub. A special seal construction for the panel edge and slot prevents leakage of the contents of the tub through the slot.

7 Claims, 2 Drawing Sheets

Fig. 2
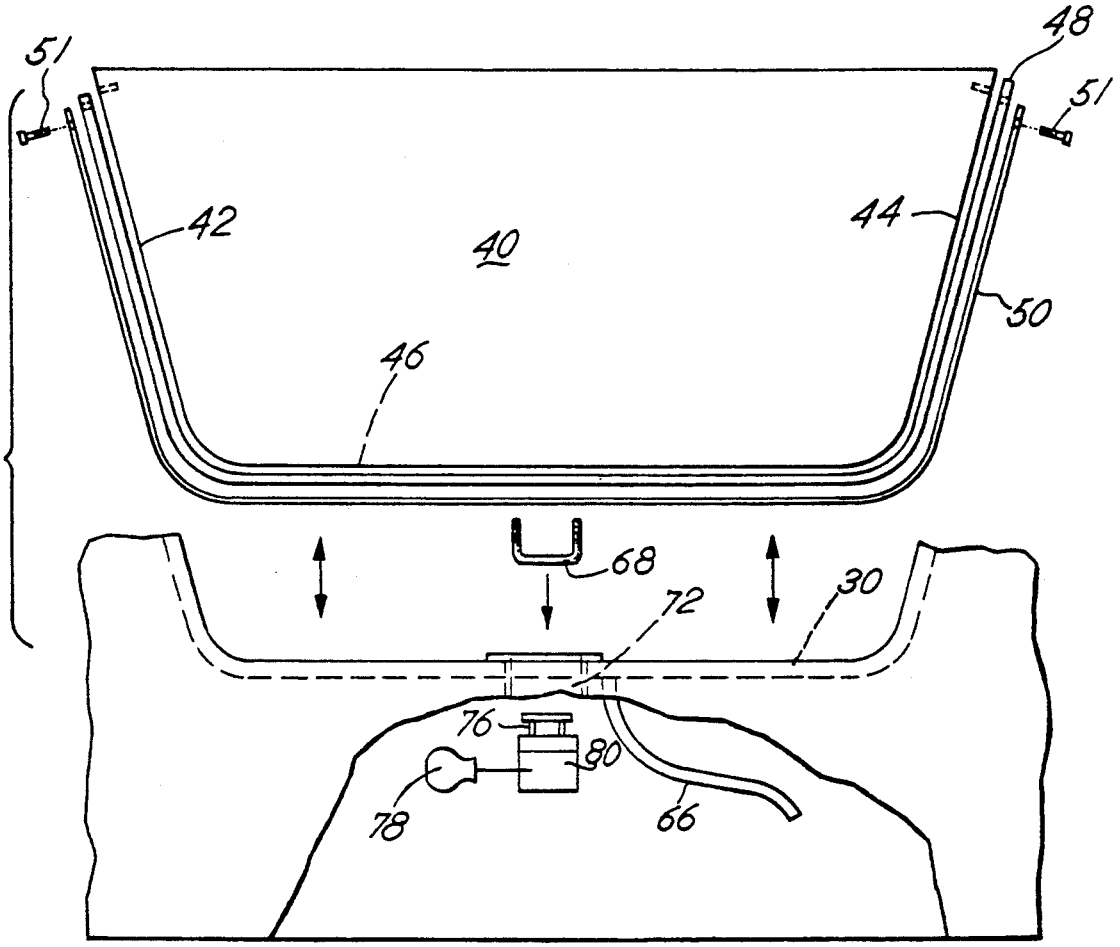
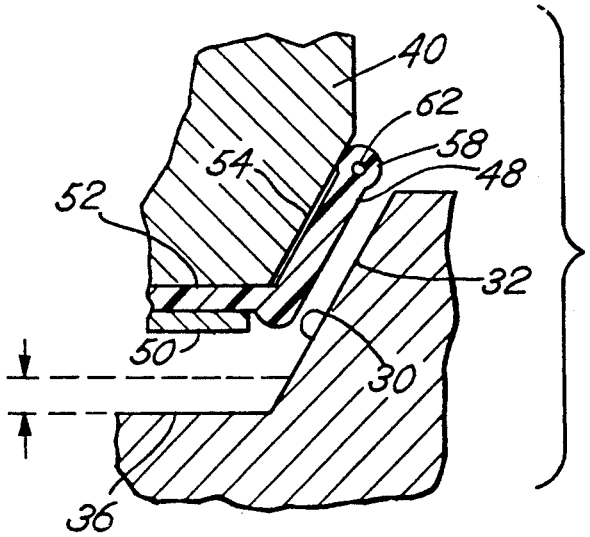
Fig. 3

BATHING TUB CONSTRUCTION WITH REMOVABLE SIDE WALL

BACKGROUND OF THE INVENTION

This invention relates to an improved bathing tub construction with a removable side wall.

Hospital patient care, nursing home patient care and other patient care often requires specialized bathing facilities wherein the ease of patient ingress and egress to the bathing enclosure is enhanced. Heretofore, various systems have been proposed for such enhancement. For example, a patient may be positioned in a chair which is then lowered by means of a crane mechanism or other mechanism into a tub enclosure. While this system works well, it requires an expensive mechanical lift mechanism for transport of the patient. Thus, there remains the need for improved constructions which enhance ease of access for a patient to a tub enclosure and ease of monitoring and assisting such a patient in that effort.

SUMMARY OF THE INVENTION

In a principal aspect, the present invention comprises an improved bathing tub construction with a removable side wall panel which upon removal enables a patient to enter the tub enclosure. The side wall panel is then repositioned in the tub construction, and the tub filled so that the patient may be bathed. The tub thus includes an opening along one side with a specially constructed slot along the edge of the opening for receipt of the side wall panel. The side wall panel includes a special seal which is retained along the edge of the panel so that when the panel is positioned in the slot, a tight seal is created. A gripping mechanism retains the panel within the slot when the tub is in use. The shape and configuration of the slot and seal, and the shape and configuration of the panel prevent leakage from the tub and also provide for ease of insertion or removal of the side wall panel in the tub side opening.

Thus, it is an object of the invention to provide an improved bathing tub construction with a removable side wall panel.

It is the further object of the invention to provide an improved bathing tub construction wherein a side wall panel includes a special seal and seal attachment means along the edge thereof for sealing engagement with a slot associated with the tub.

A further object of the invention is to provide improved means for holding a side wall panel in a slot of a tub construction.

Yet another object of the invention is to provide a tub construction wherein patient access to the tub is facilitated by a removable wall panel which can be modified so as to accommodate any desired tub depth or wall panel height to thereby facilitate monitoring of a patient within a tub.

Yet a further object of the invention is to provide an improved bathing tub construction with a removal side wall panel that is light and easy to use, yet which includes a leak-proof seal.

Another object of the invention is to provide an economical to manufacture and easy to service improved bathing tub construction.

These and other objects, advantages and features of the invention will be set forth in the detailed description which follows:

BRIEF DESCRIPTION OF THE DRAWING

In the detailed description which follows, reference will be made to the drawing comprised of the following figures:

FIG. 2 is an enlarged partially exploded front elevation of the removable side wall panel of the improved bathing tub construction depicting the slot configuration associated with the opening in the side wall of the tub enclosure;

FIG. 3 is an enlarged cross-sectional view of the sealing edge of the panel and the associated slot along the edge of the opening in the tub enclosure depicting the manner of construction of the sealing member.

DESCRIPTION OF THE PREFERRED EMBODIMENT

Figure 1:
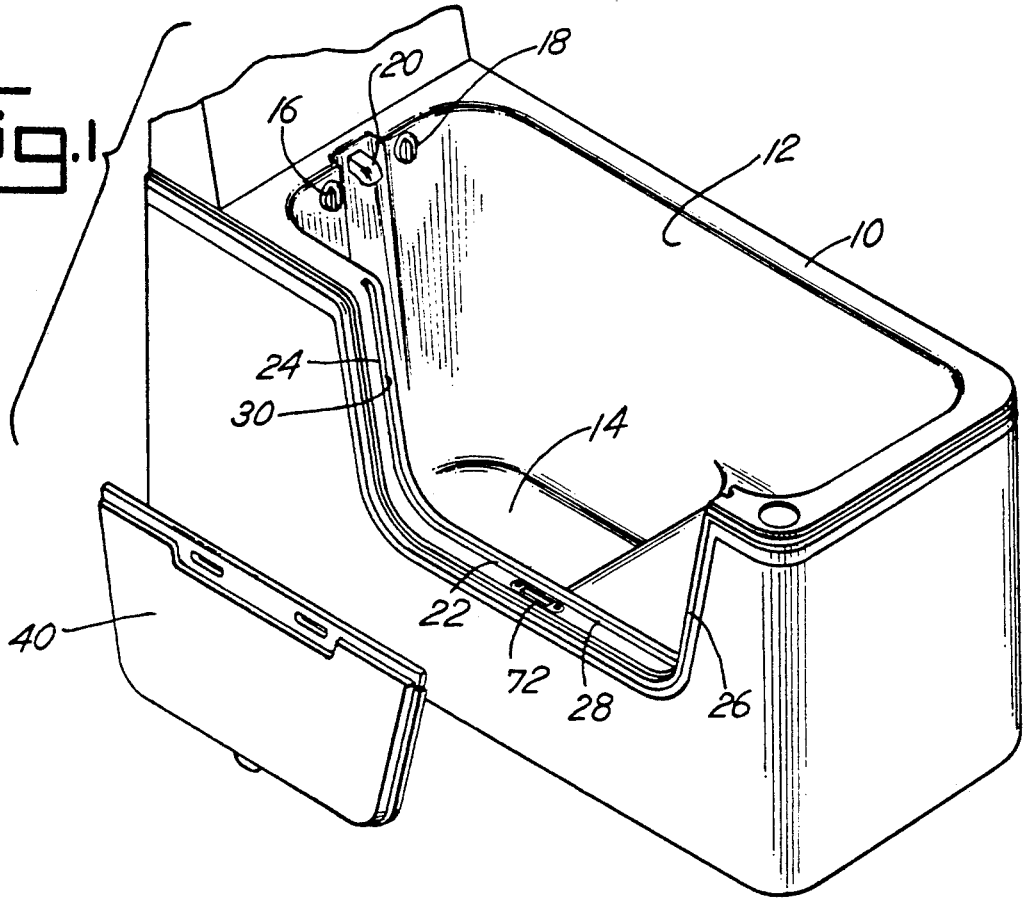
FIG. 1 is an exploded perspective view of the improved bathing tub construction of the invention with the associated removable side wall panel.

The assembly of component parts comprising the bathing tub construction of the present invention is depicted in FIG. 1. A tub or tub enclosure 10 includes a peripheral side wall 12 and a bottom wall 14. The tub 10 also includes a set of control valves 16, 18 for hot and cold water and, of course, a nozzle or faucet 20 which permits flow of water into the tub 10. The material and general construction of the tub 10 are known to those of ordinary skill in the art.

The tub 10 includes a unique feature; namely a side panel opening 22 which when viewed from the side is a generally U-shaped opening 22 with the opposite legs 24, 26 of the U opening 22 converging toward one another in the direction of the bottom wall 14. The bottom 28 of the U-shaped opening 22 connects the side legs 24 and 26. Thus, the side legs 24, 26 of the opening 22 connect with the bottom 28 to form a continuous generally U-shaped opening 22 configuration. The bottom 28 may be at the same level as the bottom wall 14 of the tub 10. Alternatively and preferably, the bottom 28 is above that level of wall 14 so that a small amount of water may be placed in the tub 10 prior to patient entry.

The opening 22 includes an elongated edge slot 30 which extends along the entire edge or periphery of the opening 22. The transverse cross-sectional shape of the slot 30 is depicted in greater detail in FIGS. 3 and 4. Briefly, the slot 30 has a generally U-shaped cross-sectional configuration and includes generally converging planer side surfaces 32 and 34 which converge towards a bottom or connecting or base surface 36. The slot 30 has this depicted cross-sectional configuration or shape uniformly along its entire length.

A tub enclosure panel 40 in FIG. 1 is assembled and configured to fit into the opening 22 and to engage with or slide into the slot 30 in the manner to be described below. Thus, referring to FIG. 2, the panel 40 has a generally U-shaped configuration with panel sides 42 and 44 connected with a base 46. The panel 40 thus has a configuration with converging sides 42 and 44 connected by base 46 that is coincident or congruent with the opening 22.

Figure 4:
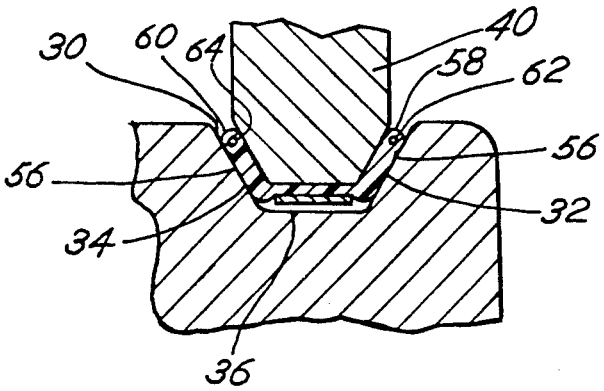
FIG. 4 is a cross-sectional view similar to FIG. 3 wherein the side wall panel has been inserted into the associated slot.

A special sealing member 48 fits along the peripheral edge of the panel 40. The sealing member is retained by a flat band 50 which is held at its opposite ends by screw fasteners 51 to the top edges of the panel 40. Thus, each screw 51 fits through band 50 and the seal 48. The band 50 retains the seal 48 tightly against the edge of the panel 40. FIGS. 3 and 4 illustrate in greater detail the construction of the edge of the panel 40. That is, the seal 48 is also generally U-shaped in configuration so that it fits over the edge. The seal 48 includes a thin base section 52 which connects legs 54 and 56. The thickness of the legs 54 and 56 is slightly greater than the thickness of the base 52. The legs 54 and 56 terminate respectively with thickened terminal ribs 58 and 60 respectively. The ribs 58 and 60 have a hollow air passage or core 62 and 64. The seal 48 is constructed of an elastermeric material and is of uniform cross-section along its length. The retention band 50 is typically comprised of stainless steel flexible strap which fits against the base 52 and is retained by fastening screws 51 to retain seal 48 against the edge of panel 40 as described above.

FIG. 4 depicts the assembly of the panel 40 in the slot 30. It should be noted that when the panel 40 is positioned within the slot 30, because of the particular configurations described, the panel 40 will become more tightly wedged in the slot 30 as it is drawn inward and downward into the slot 30. This will cause the side walls 54 and 56 of the sealing member 48 to more tightly seal the panel 40. The thickened sections 58 and 60 also effectively are compressed between panel 40, and the walls or surfaces 32, 34 of slot 30 and act to even more effectively seal the panel 40 into the slot 30. It should be noted that even when the panel 40 is tightly positioned within the slot 30, the base 52 of the seal 48 as well as the strap 50 still remain spaced from the base 36 of the slot 30. This space is utilized as a passageway for the flow of any fluids which might be leaking through the seal 48 as depicted in FIG. 2.

The slot 30, includes a drain pipe 66 leading from the lowest portion of the slot 30 to remove excess fluid. Preferably the drain pipe 66 is fashioned from a clear plastic tubing, for example, so that the collection of fluid within the drain pipe 66 can be observed. If such fluid is observed, then it is most likely that the seal 48 should be replaced by removing strap 50 and repositioning a new seal 48 for retention by strap 50 and screws 51.

In order to hold the panel 40 tightly in position, a hook member 68 projects from the mid point along the bottom of the panel 40 and extends into a slot or passage near the bottom of the opening 22. Hook member 68 thus projects through slot 72. The hook member 68, is positioned on the outside of the panel 40 and extends through a separate slot 72 in the side wall of the tub construction. There the hook member 68 is engaged by a gripping member 76 which may be motorized to engage the hook member 68 and tightly draw the hook member 68 downward in direction of the arrow in FIG. 2. This retains panel 40 tightly in sealing engagement with the slot 30. Motor 78 operates through a linkage 80 to engage the gripping member 76 against the hook 68. Of course, when the panel 40 is to be removed, the member 76 disengages from the hook 68.

It should be noted that the panel 40 may have a height which is less than the height of the side opening 22 in the tub 10. For example, if the height of the panel 40 is reduced relative to the height of the tub enclosure, a nurse or orderly will have better access to a patient within the tub 10 for purposes of assisting the patient. The panel 40 may thus have any height depending upon the needs and requirements of the patient. It should also be noted that with the unique sealing construction of the present invention, upon filling of the tub, water pressure will tend to engage the seal 48 even more tightly in the slot 30. Also, the seal 48 is designed so that sealing engagement is maintained on both surfaces or 32, 34 sides of the slot 30.

When in use, the panel 40 is initially removed from the slot 30 and opening 22. Note that the panel 40 can be made of a lightweight molded plastic, for example, so that it can be easily lifted from the slot 30. Note also that the panel 40 will slide upwardly out of the slot 30 initially, and because of the converging U-shaped sides of the opening 22 and the panel 40, the panel 40 need be raised only a few inches before it may be completely removed from the opening 22. In any event, the panel 40 is initially removed from the opening 22. The patient will then enter the tub 10. The panel 40 can then be easily lowered into the slot 30 and tightened down into the slot 30 by operation of the motor 78. The patient or attendant can then fill the tub by turning the control valves 16 and 18 as desired.

It is possible to vary the construction of the invention. For example, panel size, seal configuration, slot uniformity and length and other features may be varied. Thus, the invention is to be limited only by the following claims and their equivalents.

What is claimed is:

1. An improved bathing tub assembly having a removable side wall comprising in combination:

a tub having a bottom wall and an integral peripheral side wall defining a partial tub enclosure, a defined opening in the side wall having a lateral slot along the edge of the opening;

a removable tub enclosure panel compatibly sized to fit in and close the opening by fitting into the slot to hereby define the removable side wall, said slot having spaced, converging side surfaces, defining a generally U-shaped cross-section;

said opening also generally U-shaped with the sides of the U converging toward the base of the U;

said panel having an edge with a cross-sectional shape of the slot where by the edge is slidable into the slot;

said edge being surrounded by a sealing member which also has a U-shaped cross-section and fits over the edge side surfaces to seal against the slot side surfaces when the panel is in the slot;

said seal being retained on the edge by a band member extending against the seal along the outside of the base;

said band member being fastened at its opposite ends to the edge of the panel; and releasable means for retaining the panel in the slot.

2. The assembly of claim 1, wherein the releasable means, comprise a hook member extending from the base of the panel and further including means for gripping and pulling the hook member mounted on the tub for thereby pulling the panel tightly into the slot.

3. The assembly of claim 2 wherein the hook member is positioned generally at the midpoint of the side of the panel.

4. The assembly of claim 1 wherein the sealing member has a generally uniform thickness along each leg of the U-shaped cross-section and terminates at the end of at least one leg with a thickened compressible section.

5. The assembly of claim 1 wherein the base of the panel is spaced from the bottom of the slot when the panel is in the slot.

6. The assembly of claim 5 including a drain tube from the slot connected to the lowest part of the slot.

7. The assembly of claim 2 including motor means for pulling the hook member.

* * * * *